US007258298B2

(12) United States Patent
Heikaus

(10) Patent No.: US 7,258,298 B2
(45) Date of Patent: Aug. 21, 2007

(54) SUPPLYING DEVICE FOR FILM CORES AND METHOD FOR SUPPLYING FILM CORES

(75) Inventor: Gerd Heikaus, Nümbrecht (DE)

(73) Assignee: Illinois Tool Works Inc., Glenview, IL (US)

( * ) Notice: Subject to any disclaimer, the term of this patent is extended or adjusted under 35 U.S.C. 154(b) by 242 days.

(21) Appl. No.: 10/498,798

(22) PCT Filed: Nov. 28, 2002

(86) PCT No.: PCT/EP02/13409

§ 371 (c)(1),
(2), (4) Date: Nov. 22, 2004

(87) PCT Pub. No.: WO03/051752

PCT Pub. Date: Jun. 26, 2003

(65) Prior Publication Data

US 2005/0072873 A1 Apr. 7, 2005

(30) Foreign Application Priority Data

Dec. 18, 2001 (DE) ..... 101 62 179

(51) Int. Cl.
*B65H 19/22* (2006.01)

(52) U.S. Cl. ..... 242/533.2; 242/533.1; 242/473.5; 242/473.6

(58) Field of Classification Search .. 242/533.1–533.2, 242/432.3–432.5, 433.2–433.3, 434.9, 443, 242/473.5–473.6, 473.9, FOR. 133; 414/911
See application file for complete search history.

(56) References Cited

U.S. PATENT DOCUMENTS

| | | | | |
|---|---|---|---|---|
| 2,886,940 | A * | 5/1959 | Urano et al. | 57/271 |
| 3,531,016 | A * | 9/1970 | Pray | 221/13 |
| 3,863,751 | A * | 2/1975 | Vignon | 198/400 |
| 3,938,308 | A * | 2/1976 | Komura et al. | 57/266 |
| 4,586,668 | A * | 5/1986 | Mori | 242/474.1 |
| 5,350,128 | A * | 9/1994 | Deters et al. | 242/473.6 |
| 5,426,930 | A * | 6/1995 | Badiali et al. | 57/281 |

FOREIGN PATENT DOCUMENTS

| | | |
|---|---|---|
| JP | 11106099 | 4/1999 |
| WO | 95/13965 A1 | 5/1995 |

* cited by examiner

*Primary Examiner*—Gene O. Crawford
*Assistant Examiner*—Sang Kim

(57) ABSTRACT

A preparatory device provided for arranging film roll cores in a condition ready for use for a film roll winding machine, in which the film roll cores are vertically arranged, comprises a supply device for supplying horizontally disposed film roll cores. The supply device is connected with an erecting device serving for moving a film roll core from a horizontal position into a vertical position. With the aid of a transfer device the film roll core is taken out of the erecting device and transferred to the film roll winding machine.

23 Claims, 4 Drawing Sheets

SUPPLYING DEVICE FOR FILM CORES AND METHOD FOR SUPPLYING FILM CORES

CROSS-REFERENCES TO RELATED APPLICATIONS

This application corresponds to International Application No. PCT/EP02/13409, filed Nov. 28, 2002, which claims benefit of German Application Ser. No. 101 62 179.5, filed Dec. 18, 2001, the entire disclosures of which are hereby incorporated by reference.

FIELD OF THE INVENTION

The invention relates to a preparatory device provided to arrange film roll cores in a condition ready for use as well as to a method for arranging film roll cores in a condition ready for use.

BACKGROUND OF THE INVENTION

Film rolls are normally produced with the aid of winding machines by winding a film sheet off a first film roll and winding it up to a film roll core. In this connection the film sheet wound up to the first roll is normally a great deal longer than the film sheet wound up to the core. The produced film roll with a smaller diameter can then e.g. be used in suitable handling means for manually wrapping up pallets or the like. It is further possible to produce a stretched, i.e. preextended, film sheet with the aid of the winding machine. Besides the use of the produced film rolls in manually operated unroll means or the like, such film rolls are also employed in automatic pallet wrapping-up devices and the like. A device for producing film rolls comprising a prestretched film sheet is, for example, described in WO 95/13965.

The film roll cores are, for example, hollow tubular cardboard cores. The film roll cores must be manually inserted into existing film roll winding machines, and the ready-wound film rolls must be manually removed from the winding machine.

SUMMARY OF THE INVENTION

It is an object of the invention to further automate the production process for film rolls.

The inventive preparatory device provided for arranging film roll cores in a condition ready for use for a film roll winding machine comprises a supply device with the aid of which the horizontally arranged film roll cores are supplied. The supply device has connected thereto an erecting device with the aid of which the horizontally arranged film roll cores are moved from their horizontal position into a vertical position. In the vertical position the film roll cores are then taken up with the aid of a transfer device and transferred to the film roll winding machine. The film roll core is then vertically arranged in the winding machine such that the film roll is wound up with the film rolls being in their vertical position. In the case of such winding machines provided for vertical arrangement of the film rolls, the film roll cores must be supplied in vertical position. Since direct vertical supply of the film roll cores involves excessive technical expenditure and difficulties, the film roll cores are, according to the invention, supplied in horizontal position via a supply device, with the film roll cores being subsequently placed into the vertical position with the aid of the erecting device.

With the aid of the preparatory device provided for arranging film roll cores in a condition ready for use according to the invention it is thus possible to automatically supply film roll cores to a film roll winding machine. This leads to a considerable reduction of the film roll production costs.

The transfer device may, for example, be a gripping arm or the like which takes up the film core with the aid of gripping pliers or the like and then moves the film core from a take-up position into a transfer position in which the film roll core is then transferred, for example, to a holder of the winding machine. The erecting device may be integrated in the transfer device which is configured, for example, as a gripping arm. For this purpose, the gripping arm is, for example, configured such that the gripping pliers, with their opening facing downwards, are guided over the horizontally arranged film roll core and can grip the latter. Then the pliers and/or the gripping arm are/is pivoted by 90° such that the film roll core is substantially vertically aligned, with the film roll core being moved into the transfer position before, after or during the 90°-pivoting process.

In a preferred embodiment, the erecting device comprises a receiving means for receiving one single film roll core. The receiving means is a depressed portion or a trough whose cross-section preferably substantially corresponds to the outer dimensions of the film core. Since thus only a single film roll core can be received in the receiving means, said film roll core can be easily removed from the receiving means, for example with the aid of the gripping arm. Preferably, the receiving means is connected with a pivoting means for erecting the film cores. The single film roll core located in the receiving means is thus placed into the vertical position by pivoting the receiving means by 90°. In the vertical position the film roll core can then be taken up by the transfer device, such as a gripping arm, and moved into the transfer position.

The supply device is preferably connected with a singling means for singling the film roll cores. The singling means may e.g. be a slider placed between two film roll cores arranged one behind the other such that always only one of the two film roll cores can be removed. Further, a slider may be provided which engages in the tubular film roll cores from the side thus always releasing only one film roll core at a time which is then preferably transported to the receiving means, e.g. by rolling over an inclined plane, such that always only one film roll core is arranged in the receiving means.

The invention further relates to a method for arranging film roll cores in a condition ready for use for a winding machine, in particular a winding machine provided for vertical arrangement of the film rolls. According to the invention, the film roll cores are made available in horizontal position. In the next step, a film roll core is erected out of the horizontal position and placed into a vertical position. In this vertical position the film roll core is transferred to the winding machine. Since both erecting the film roll core and transferring the film roll core are carried out automatically, this method helps to increase the degree of automation for producing film rolls.

The film roll cores are preferably made available via a supply device containing a plurality of film roll cores. Preferably, the film roll cores are automatically singled by a singling means such that the single film roll cores can be easily erected.

Particularly preferred is the use of the preparatory device according to the invention for carrying-out the inventive method.

BRIEF DESCRIPTION OF THE DRAWING

Hereunder the invention is explained in detail in connection with preferred embodiments with reference to the accompanying drawings in which.

DETAILED DESCRIPTION OF THE INVENTION

Figure 2:
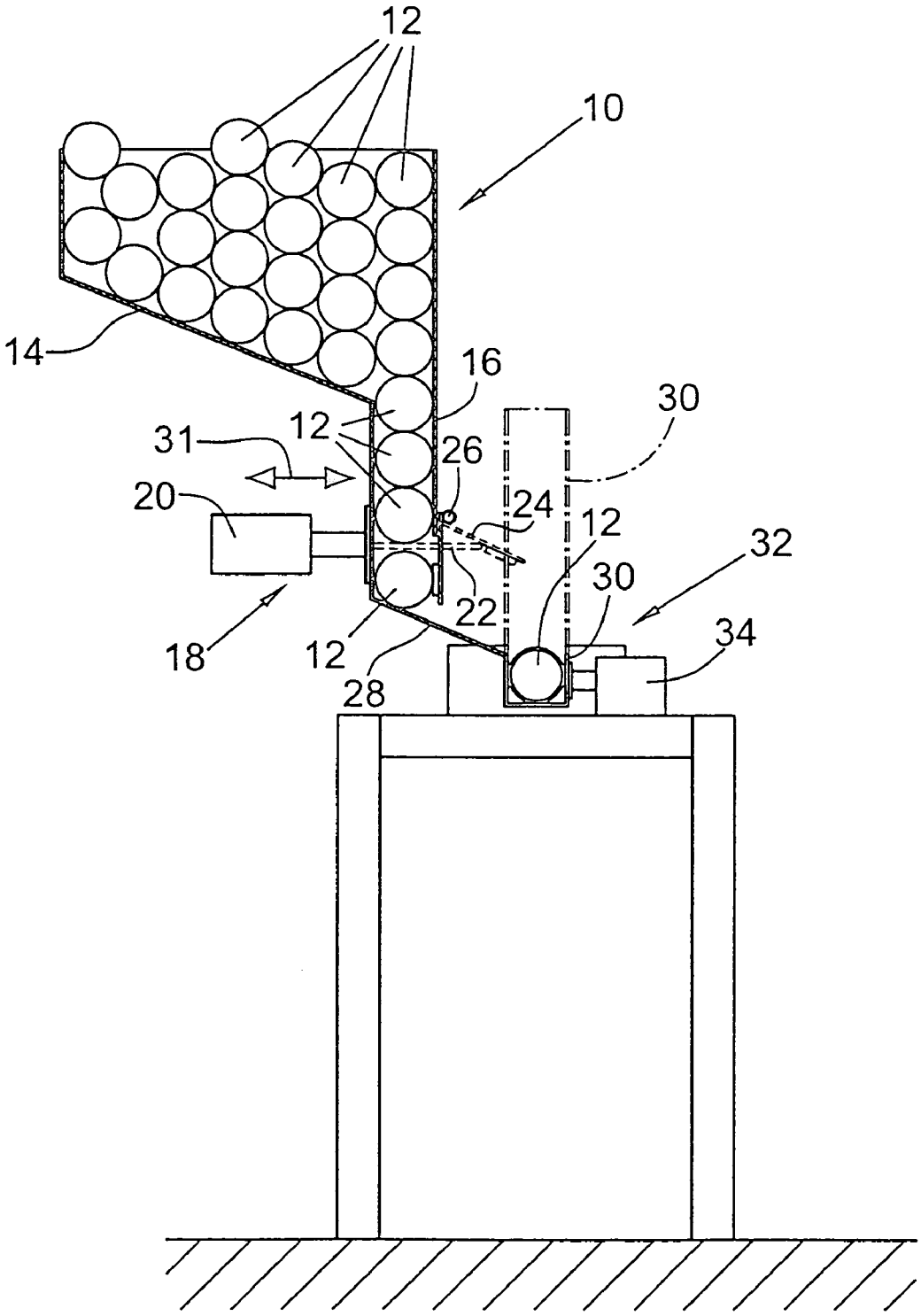
FIG. 2 shows a schematic sectional view along line II-II of FIG. 1.

In a supply device 10 a plurality of film roll cores 12 are arranged in a portion configured as a chute or the like, wherein the cores 12 are positioned in a mutual parallel arrangement in the supply device 10. Here, the film roll cores 12 are horizontally arranged. The supply device 10 portion configured as a chute 14 is connected with a supply channel 16. The dimensions of the supply channel 16 are selected such that the width of the supply channel is slightly larger than the diameter of a film roll core 12. The film roll cores 12 are thus arranged one behind the other in transport direction, i.e. in downward direction in FIG. 2, in the supply channel. To ensure that the film roll cores descend, the chute and/or the hopper-shaped portion 14 comprises an inclined underside ending, in the illustrated embodiment, in the vertically aligned supply channel 16.

The supply device 10 is provided with a singling means 18 arranged at the end of the supply channel 16. The singling means 18 comprises a slider 22 connected with an actuator 20. The slider 22 serves, on the one hand, for opening a retaining means, which is configured as a damper 24, by pivoting about an axis 26 such that the lowermost film roll core 12 in the supply channel 16 rolls via an inclined plane 28 towards an erecting device 32. Moreover, the slider 22 serves for retaining the following film roll core 12 in the supply channel 16. By pulling back the slider 22 in the direction indicated by arrow 32, i.e. to the left in FIG. 2, the damper 24 is closed again and the film roll core 12 retained by the slider 22 slips downwards to the place of the film roll core 12 retained by the damper 24. To prevent the film roll cores from getting jammed, two sliders 22 (FIG. 1) are provided.

The film roll core 12, which rolled over the inclined plane 28, falls into the receiving means 30. The receiving means 30 substantially has a width which is only slightly larger than the diameter of the film roll core. The length of the receiving means 30 also substantially corresponds to the length of the film roll core. In the illustrated embodiment, the receiving means 30 has a U-shaped cross-section and is configured as a box or trough. The receiving means 30 is connected with a pivoting means 34. The pivoting means 34 is connected with one end of the receiving means 30 such that, upon actuation of the pivoting means 34, the trench- or trough-shaped receiving means 30 is pivoted by 90° into the position shown by dashed lines in FIG. 2. Thereby the film roll core 12 is erected into a vertical position.

Figure 3:
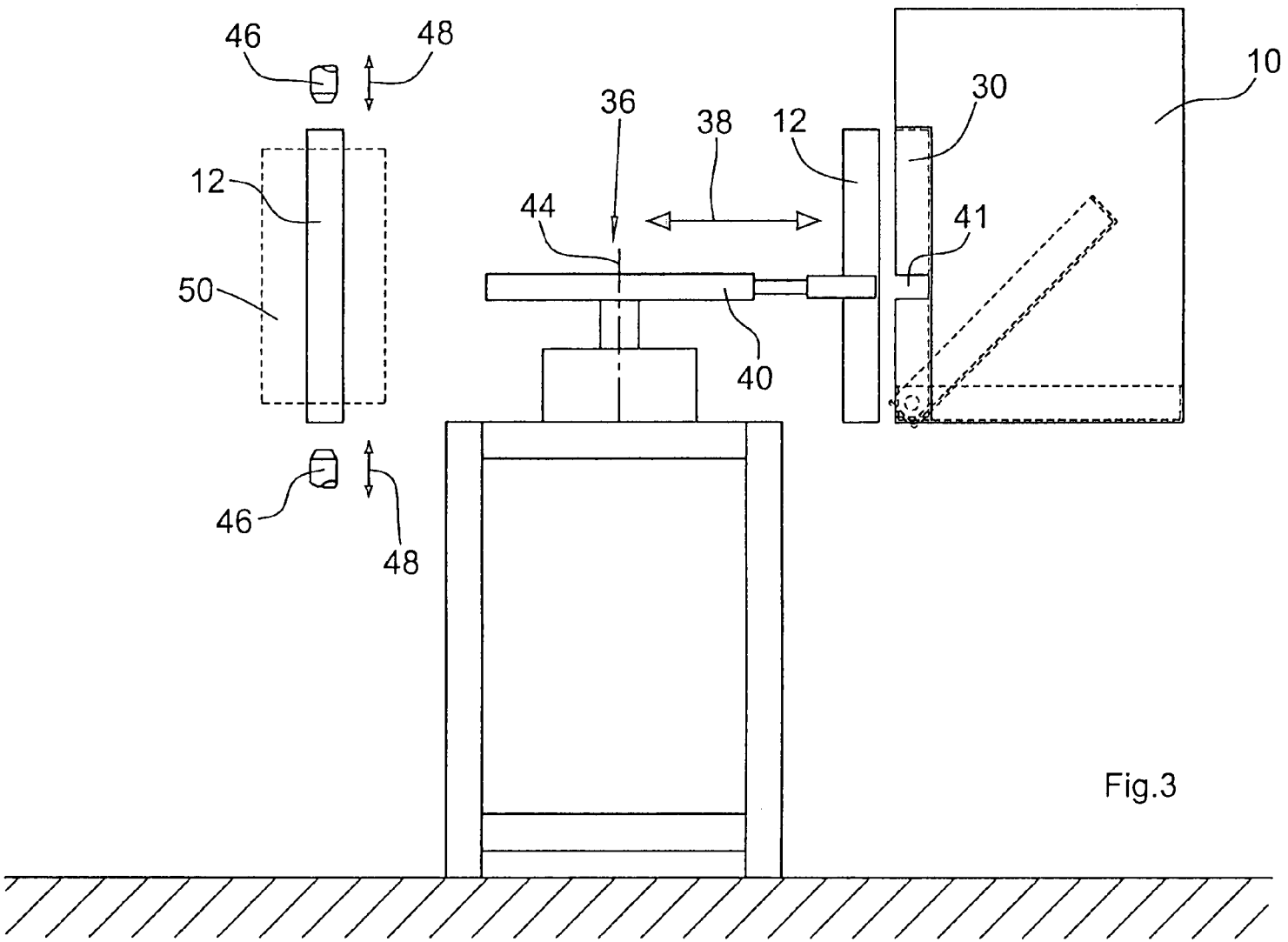
FIG. 3 shows a schematic front view of the device according to the invention.

The film roll core 12 vertically arranged in the receiving means 30 is then taken up by a transfer device 36. For this purpose, the transfer device 36 comprises, in the illustrated embodiment, a telescopic gripping arm 40 provided with gripping pliers 42 and displaceable in the direction indicated by arrow 38. For taking up the film core roll 12, the gripping arm is horizontally displaced out of the position shown in FIGS. 1 and 3 such that the gripping pliers 42 are inserted into a slot 41 provided in the receiving means 30 thus gripping the film roll core. Then the gripping arm 40 is retracted such that the gripping pliers 42, together with the film roll core 12, are placed into the position shown in FIGS. 1 and 3. The gripping pliers 42 are thus retracted from the take-up position in which the film roll core is taken up. Subsequently the gripping arm 40 is pivoted about an axis 44, in the illustrated embodiment by approximately 180°, such that the film roll core is transferred or moved into a transfer position in which the film roll core 12 is transferred to holders 46 (FIG. 3) of a winding machine which is not shown. For receiving the film roll core 12, the holders 46 are displaceable in the direction indicated by arrow 48. When the gripping arm 40 is being pivoted from the position shown in FIGS. 1 and 3 into the transfer position, the gripping arm 40 is extended again since the gripping arm must be retracted again after delivery the film roll core 12 to the winding machine, i.e. after the holders 46 have received the film roll core 12, in order to allow a film sheet 50 (FIG. 3) to be wound up to the film roll core 12. Winding-up the film sheet 50 to the film roll core 12 is effected with the aid of a winding machine which is not shown, wherein the holders 46 form part of the winding machine.

Figure 1:
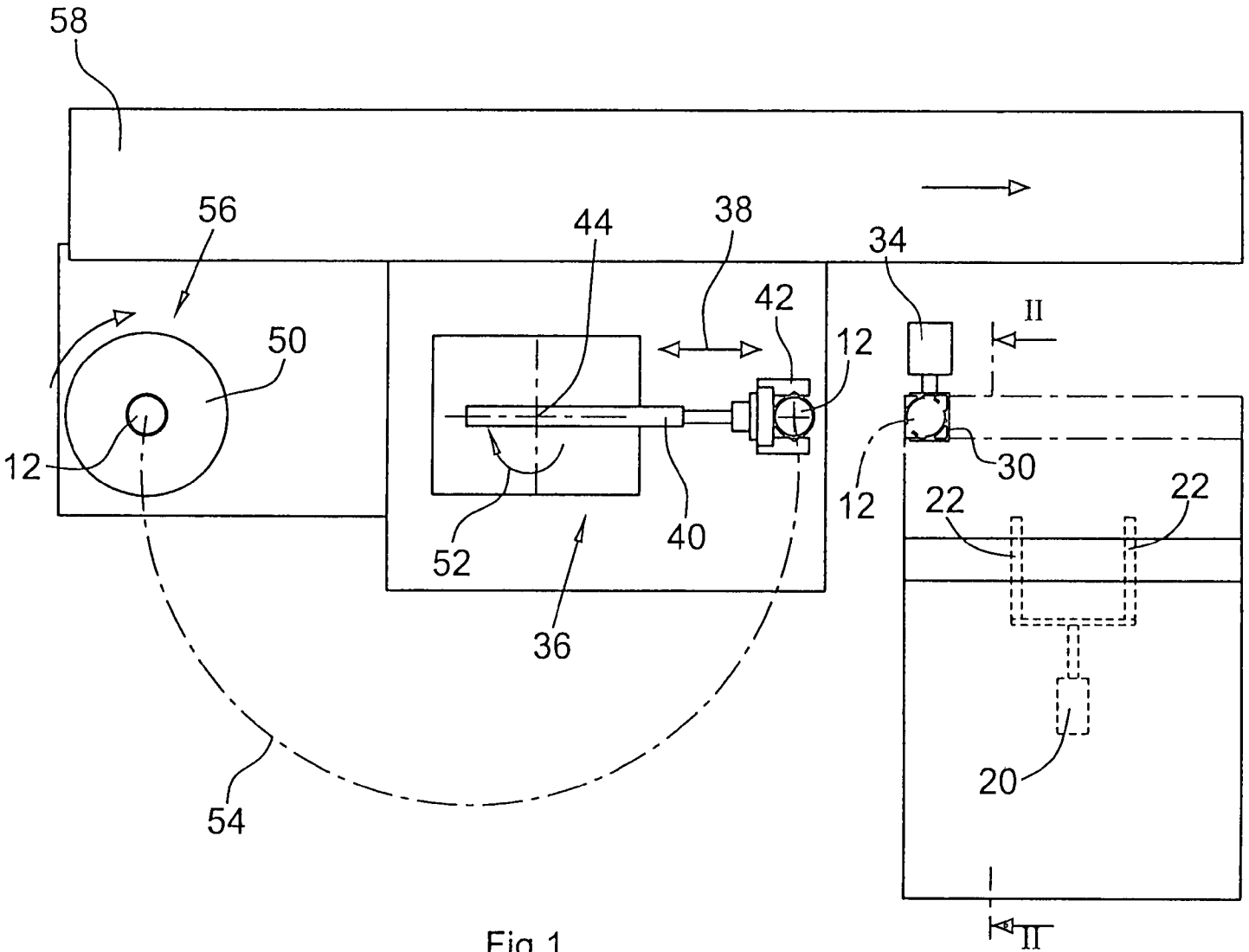
FIG. 1 shows a schematic plan view of the preparatory device according to the invention.

The movement performed by the film roll core 12 when the gripping arm 40 is pivoted about the axis 44 in the direction indicated by arrow 52 is exemplified by the dashed line 54 in FIG. 1. In this connection it is assumed that the gripping pliers 42 are extended during the pivoting movement. Of course, the extending movement of the gripping pliers 42 may, for example, be performed only in part or may already be terminated at the beginning of the pivoting movement.

After a film sheet 50 of the desired film sheet length has been wound-up to the film roll core 12 by the winding machine, the film roll 56 must be delivered from the winding machine. This is effected by delivering the film roll 56 to a conveyor belt 58 and transporting it to a packing station or the like. To ensure a defined placing of the film roll 56 onto the conveyor belt 58 the invention provides for the upper holder 46 to be pulled upwards in the direction indicated by arrow 48. This causes the film roll 56 to tilt.

To ensure that the film roll 56 tilts towards the conveyor belt 58, the gripping arm 40 and/or the gripping pliers 42 push against the film roll immediately after it has been removed from the holder 46 such that the pulse guarantees a defined tilting of the film roll towards the conveyor belt 58.

Figure 4:
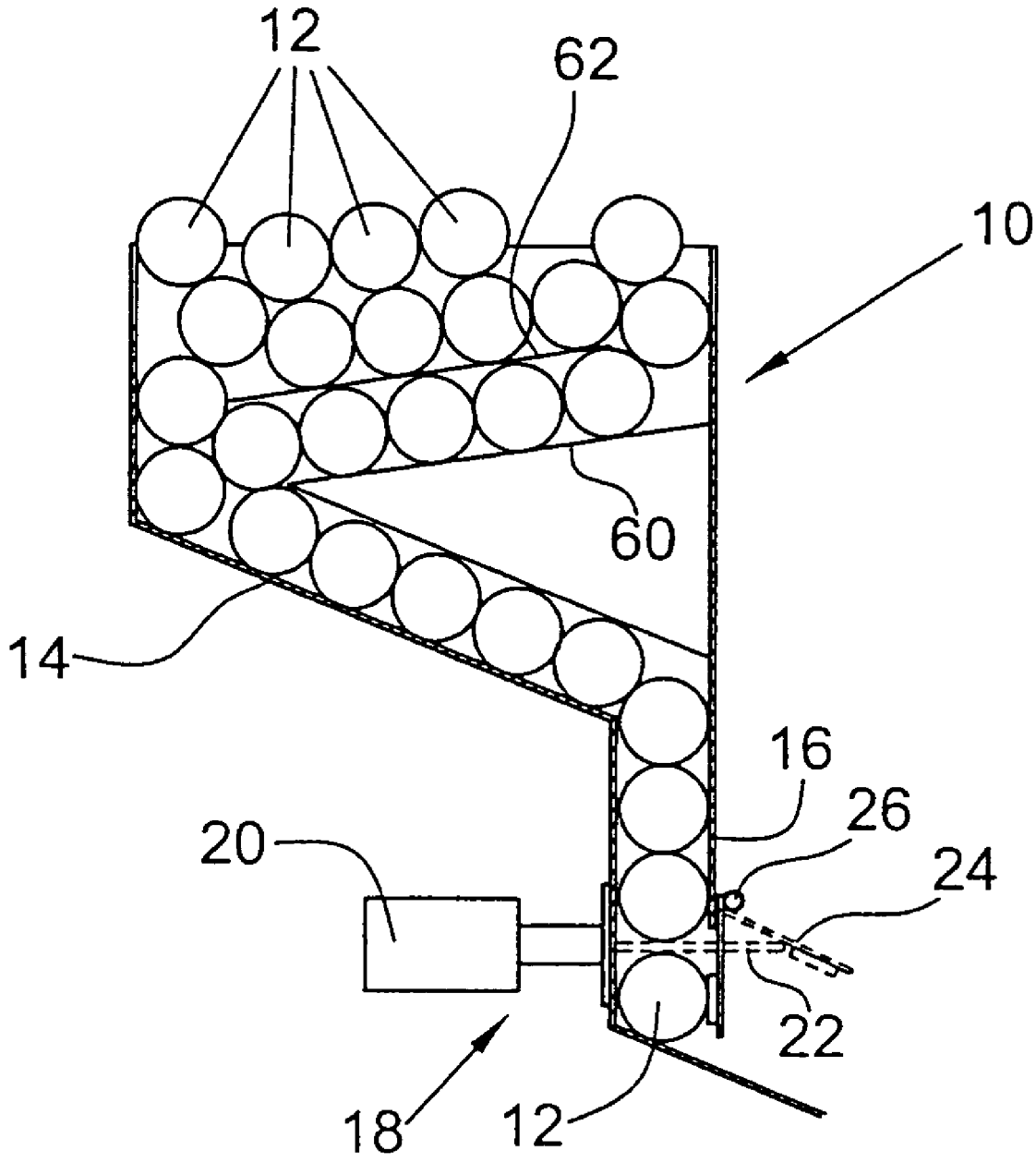
FIG. 4 shows a second preferred embodiment of the supply device.

Another preferred embodiment of the supply device 10 (FIG. 4) comprises partition walls 60,62 in the hopper-shaped portion 14. The partition walls 60,62 are disposed such that the film roll cores 12 are prevented from getting jammed or wedged in the transition between the hopper-shaped portion 14 and the supply channel 16. The inclinedly arranged partition walls 60,62 cause a presorting due to which the film roll cores are arranged in series at an early stage.

The invention claimed is:

1. A preparatory device for providing film roll cores to a film roll winding machine, said device comprising:

a supply device for supplying horizontally arranged film roll cores, an erecting device for placing the film roll core into a vertical position, and a transfer device for taking up and transferring the film roll core to the film roll winding machine wherein said erecting device is movable upward from a first position, where said erecting device is adapted to receive one of the film roll cores in a horizontal position, to a second position, where said erecting device is adapted to place the received film roll core into a vertical position.

2. The preparatory device according to claim 1, wherein the erecting device defines a cavity for receiving a single film roll core.

3. The preparatory device according to claim 2, wherein the erecting device is pivotable about a pivot for erecting the received film core from the horizontal position to the vertical position.

4. The preparatory device according to claim 3, wherein a wall of the cavity has an opening through which the transfer device is passable to take up the erected film roll core for further transfer to the winding machine.

5. The preparatory device according to claim 4, wherein the transfer device comprises a gripping arm for taking up the film roll cores provided by the erecting device at the take-up position, said gripping arm is telescopically extendable and retractable to hold the film roll core.

6. The preparatory device according to claim 1, wherein the supply device includes a hopper and a chute.

7. The preparatory device according to claim 6, wherein the hopper is configured for arranging the film roll cores one behind the other in a transport direction.

8. The preparatory device according to claim 7, wherein a lower portion of the hopper has an upright channel configured for arranging the film roll cores in a single column, one above the other in the transport direction.

9. The preparatory device according to claim 8, wherein the hopper comprises a plurality of partition walls disposed therein, said partition walls being adapted to prevent the film roll cores from getting jammed or wedged while moving through the hopper to the upright channel.

10. The preparatory device according to claim 9, wherein each of said partition walls defines an inclined surface thereby facilitating the movement of the film roll cores, in a single file, one behind another, down to the upright channel.

11. The preparatory device according to claim 1, wherein the supply device comprises a singling element for singling the film roll cores, said singling element moveable between an opened position and a closed position.

12. The preparatory device according to claim 11, wherein said singling element is a flap pivotable between the opened and closed positions about a pivot and connected to and actuated by an actuator.

13. The preparatory device according to claim 1, wherein the transfer device is movable from a take-up position, where the erecting device along with the film roll core is in a vertical position, to a transfer position, where the film roll core is held by a plurality of holders of the film roll winding machine.

14. The preparatory device according to claim 13, wherein the transfer device comprises a gripping arm for taking up the film roll cores provided by the erecting device at the take-up position.

15. The preparatory device according to claim 14, wherein said gripping arm is telescopically extendable and retractable so as to facilitate movement thereof between the take-up position and the transfer position.

16. The preparatory device according to claim 1, wherein said erecting device, in the second position, and said transferring device are coelevational.

17. A method of providing film roll cores to a film roll winding machine, comprising the steps of:

arranging a film roll core in a horizontal position;

receiving the film roll core in the horizontal position in an erecting device;

erecting the erecting device upwardly from a first position, where said erecting device receives the film roll core in the horizontal position, to a second position, where said erecting device places the received film roll core into a vertical position; and transferring the film roll core to the film roll winding machine by a transfer device.

18. The method according to claim 17 further comprising supplying a plurality of film roll cores to supply device upstream of said erecting device.

19. The method according to claim 17, wherein the film roll cores are singled prior to being received by the erecting device.

20. The method according to claim 17, wherein said erecting the erecting device comprises pivoting said erecting device about a pivot.

21. The method according to claim 17, wherein the erected film roll core is taken up by the transfer device in a take-up position and placed by the transfer device into a transfer position upstream of said winding machine.

22. The method according to claim 21, wherein said transfer device follows a semi-circular path rotating 180 degrees from the take-up position to the transfer position.

23. The method according to claim 17, wherein the film roll wound by the winding machine is pushed out of a holder of the winding machine onto a conveyor by the transfer device.

* * * * *